US006227832B1

(12) United States Patent
Rechberger

(10) Patent No.: US 6,227,832 B1
(45) Date of Patent: May 8, 2001

(54) ROTATING PISTON MACHINE

(76) Inventor: Michael Rechberger, Linzerstrasse 16, A-4170, Haslach an der Mühl (AT)

( * ) Notice: Subject to any disclaimer, the term of this patent is extended or adjusted under 35 U.S.C. 154(b) by 0 days.

(21) Appl. No.: 09/486,771

(22) PCT Filed: Sep. 1, 1998

(86) PCT No.: PCT/AT98/00204

§ 371 Date: May 16, 2000

§ 102(e) Date: May 16, 2000

(87) PCT Pub. No.: WO99/11907

PCT Pub. Date: Mar. 11, 1999

(30) Foreign Application Priority Data

Aug. 28, 1997 (AT) ..... 1446/97

(51) Int. Cl.[7] ..... F03C 2/00
(52) U.S. Cl. ..... 418/150; 418/92
(58) Field of Search ..... 418/92, 150

(56) References Cited

U.S. PATENT DOCUMENTS

| | | | | |
|---|---|---|---|---|
| 2,985,110 | * | 6/1961 | Burt et al. | 418/150 |
| 3,785,758 | * | 1/1974 | Adams et al. | 418/150 |
| 3,873,246 | * | 3/1975 | Hansen | 418/150 |
| 4,616,984 | * | 10/1986 | Inagaki et al. | 418/150 |

FOREIGN PATENT DOCUMENTS

| | | | | |
|---|---|---|---|---|
| 165176 | * | 10/1958 | (DE) | 418/150 |
| 3824882 | * | 1/1990 | (DE) | 418/150 |
| 57-097094 | * | 6/1982 | (JP) | 418/150 |
| 62-271985 | * | 11/1987 | (JP) | 418/150 |
| 1-125588 | * | 5/1989 | (JP) | 418/150 |
| 1321919 | * | 7/1987 | (SU) | 418/150 |

* cited by examiner

*Primary Examiner*—Thomas Denion
*Assistant Examiner*—Theresa Trieu
(74) *Attorney, Agent, or Firm*—Kilpatrick Stockton

(57) ABSTRACT

The invention pertains to a rotary piston machine in which a rotor rotates in an enclosure and radially movable slides in the rotor form chambers of varying volume between the enclosure and the rotor, wherein an even number of slides is provided and mutually opposing slides are joined together into a rigid unit.

The invention is characterized in that the rotor is arranged eccentrically in the enclosure, in that, in polar coordinates with the center in the rotor shaft, the inside wall of the enclosure (32) satisfies the following equation:

$$r_{(j)}=\{a>b>/[a> \cos>(1(j+D/2))+b>> \sin >>(1(j+D/2))]\}^{1/2}$$

where:
b is the shortest distance between the rotor shaft and the enclosure wall in the south pole (S),
a is given by the formula $$a_{(d,b)}=\{[3(d/2)^4-2b>(d/2)>]/[2(d/2)>-b>]\}^{1/2}$$

where:
d is the length of slides and 1 is given by the formula $$1=2/D \text{ arccos } (\{[a>-(a^4+b^4-a>b>)^{1/2}]/(a>>-b>)\}^{1/2}).$$

4 Claims, 10 Drawing Sheets

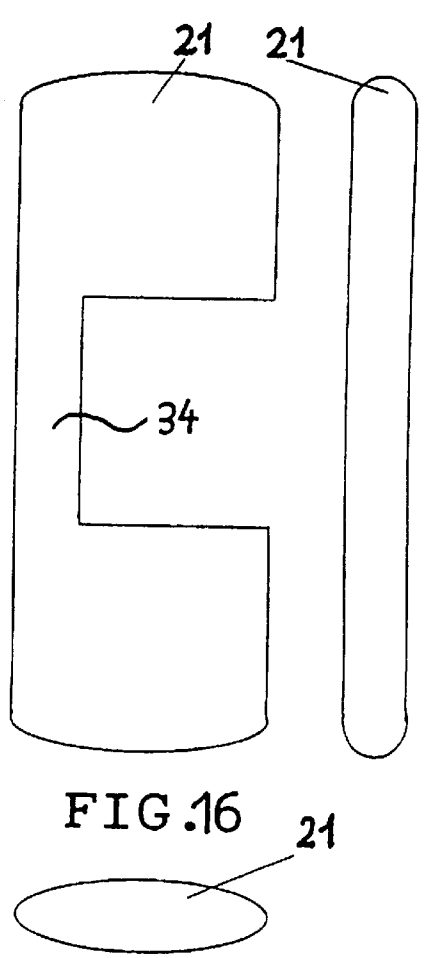
FIG.16
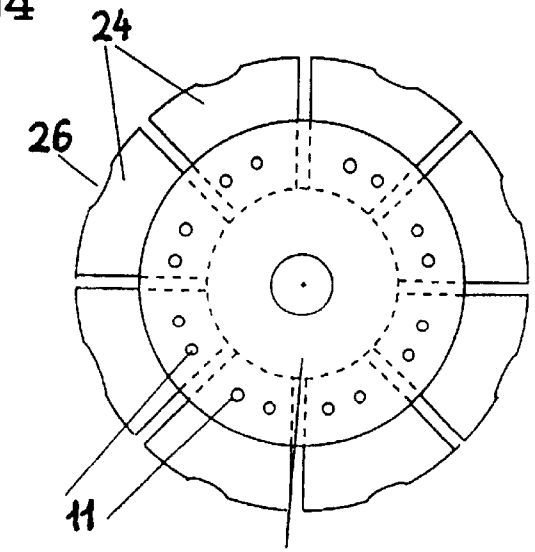
FIG.14
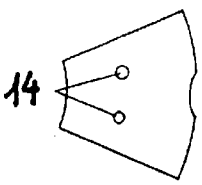
FIG.15
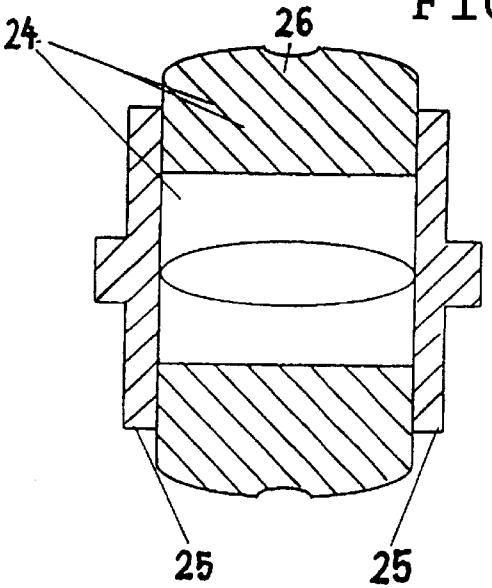
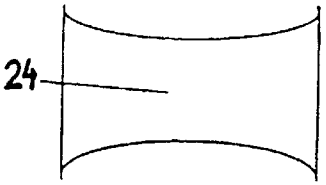

ROTATING PISTON MACHINE

BACKGROUND OF THE INVENTION

The invention pertains to a rotary piston machine in which a rotor rotates in an enclosure and radially movable slides in the rotor form chambers of varying volume between the enclosure and the rotor, wherein an even number of slides are provided and mutually opposing slides are joined together into a rigid unit.

Such a rotary piston machine is known from GB 430 715 B. Here the enclosure has the form of a Reuleaux triangle and the rotor is arranged centrally in the triangle. The advantage of such an arrangement over and above the use of one-sided spring-loaded slides is that in the rotation of the rotor, the enclosure wall need overcome only the inertial mass of the slide to move it back and forth while the centrifugal acceleration is at least essentially cancelled by the joining of the diametrically opposing slides, and spring forces that must always be provided for individual slides in order to press them against the wall in the first place can be completely eliminated.

Thus, a rotary piston machine of the type mentioned initially is subjected to considerably reduced wear in comparison to rotary piston machines with individually movable slides.

As more distant prior art pertaining to these other rotary piston machines that one can refer to, for instance, to DD-33 914 A in which the enclosure has a circular cross section, and the rotor arranged eccentrically in the enclosure likewise has an essentially circular cross section but with recesses bounded in cross section by a circular arc being cut out of the rotor in order to increase the size of the chambers formed. The (four) slides are each pressed outward from the rotor by springs against the enclosure wall, which, together with the centrifugal acceleration, leads to large contact pressures and high wear.

Despite its advantages over and above DD-A, it is disadvantageous in the rotary piston machine known from GB-B in that, because of the compulsorily prescribed shape of a Reuleaux triangle, the formation of three enclosure pockets is inevitable during rotation, each pocket forming by a slide an initially expanding and then again shrinking chamber between the slides. In internal combustion engines, for instance, this necessarily leads to the formation of 6-stroke systems with intervening cooling sections. Another disadvantage caused by this is that each slide is pushed radially back and forth three times during a rotation which in turn in the course of a rotation leads to relatively high acceleration peaks.

SUMMARY OF THE INVENTION

The invention intends to create a remedy for this, and to specify a rotary piston machine of the type defined initially in which each slide is pushed back and forth only once in a [single] rotation of the rotor.

This is achieved, according to the invention, in that the rotor is arranged eccentrically in the enclosure, in that the enclosure is symmetrical with respect to the connection line between the shaft of the rotor and the point of the enclosure closest to this axis, the south pole and in that, based on an XY coordinate system placed through the axis of rotation of the rotor and running orthogonally to and in the direction of the axis of symmetry, and with polar coordinates (r, j) with their center in the rotor shaft and the angle j=0 lying in the direction of the positive X-axis, the inside wall of the enclosure satisfies the following equation:

$$r_{(j)}=\{a>>b>>/[a>> \cos >>(1(j+D/2))+b>> \sin >>(1(j+D/2))]\}^{1/2}$$

where:

b is the shortest distance between the rotor shaft and the enclosure wall at the south pole, a is given by the formula $$a_{(d,b)}=\{[3(d/2)^4-2b>>(d/2)>>]/[2(d/2)>>-b>>]\}^{1/2}$$

where:

d is the length of the chords of the inside enclosure wall through the axis of rotation of the rotor, thus, the radial extension of the slides, and 1 is given by the formula $$1=2/D \text{ arccos } (\{[a>>-(a^4+b^4-a>>b>>)^{1/2}]/(a>>-b>>)\}^{1/2})$$

Thus, the shape of the inside enclosure wall is completely determined by the choice of b and d; that is, the shortest distance between rotor shaft and inside enclosure wall, on the one hand, and the radial extension of the slides, on the other, since due to the requirement of symmetry with respect to the Y-axis, the curve need only be fixed in one quadrant and it will be fixed in the other quadrant; the others [sic; other parameters] result immediately.

Added to the above are the boundary conditions: the horizontal profile (parallel to the X-axis) at the south pole (that at the north pole will result automatically), the position of the inside enclosure wall at the intersection with the X axis in a spacing d, the requirement for continuous differentiation two times in order to design the rotation-displacement motion of the slides without any jumps, monotonic increase of $r_{(j)}$ in the fourth quadrant and always non-negative curvature, whereby the curve is fixed.

Configurations of the invention pertain to the formation of the slides and their guidance in the rotor or along the enclosure.

BRIEF DESCRIPTION OF THE DRAWING

In the drawing, some sections through the enclosure or rotors are schematically represented according to the invention. Shown are:

FIG. 14, a rotor in section and side view;

FIG. 15, a rotor segment in front view and side view; and

FIG. 16, a slide in section, plan view and side view;

DETAIL DESCRIPTION OF PREFERRED EMBODIMENTS

Figure 1:
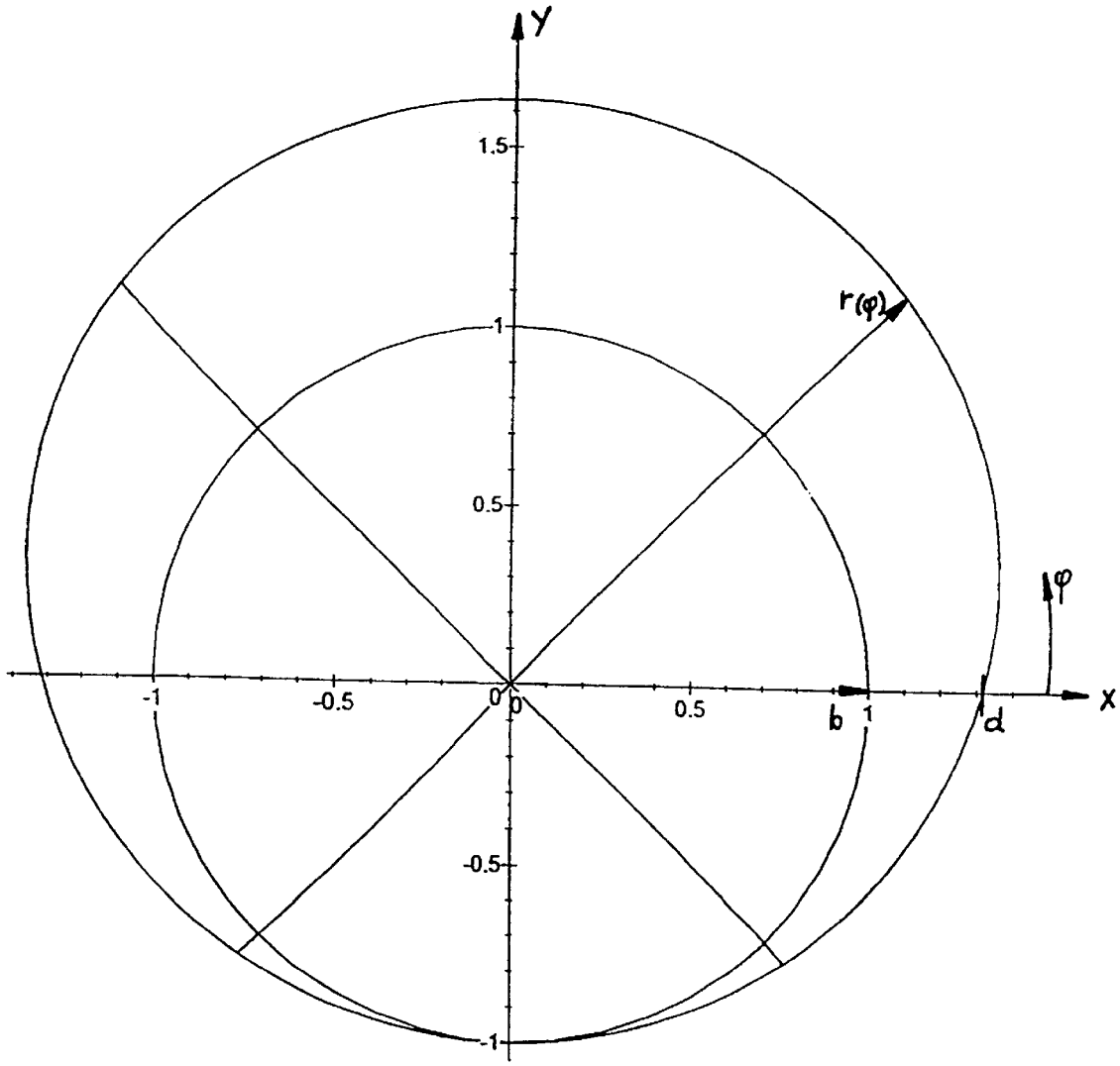
FIG. 1, an enclosure shape with a=1.5 and b=1.
Figure 2:
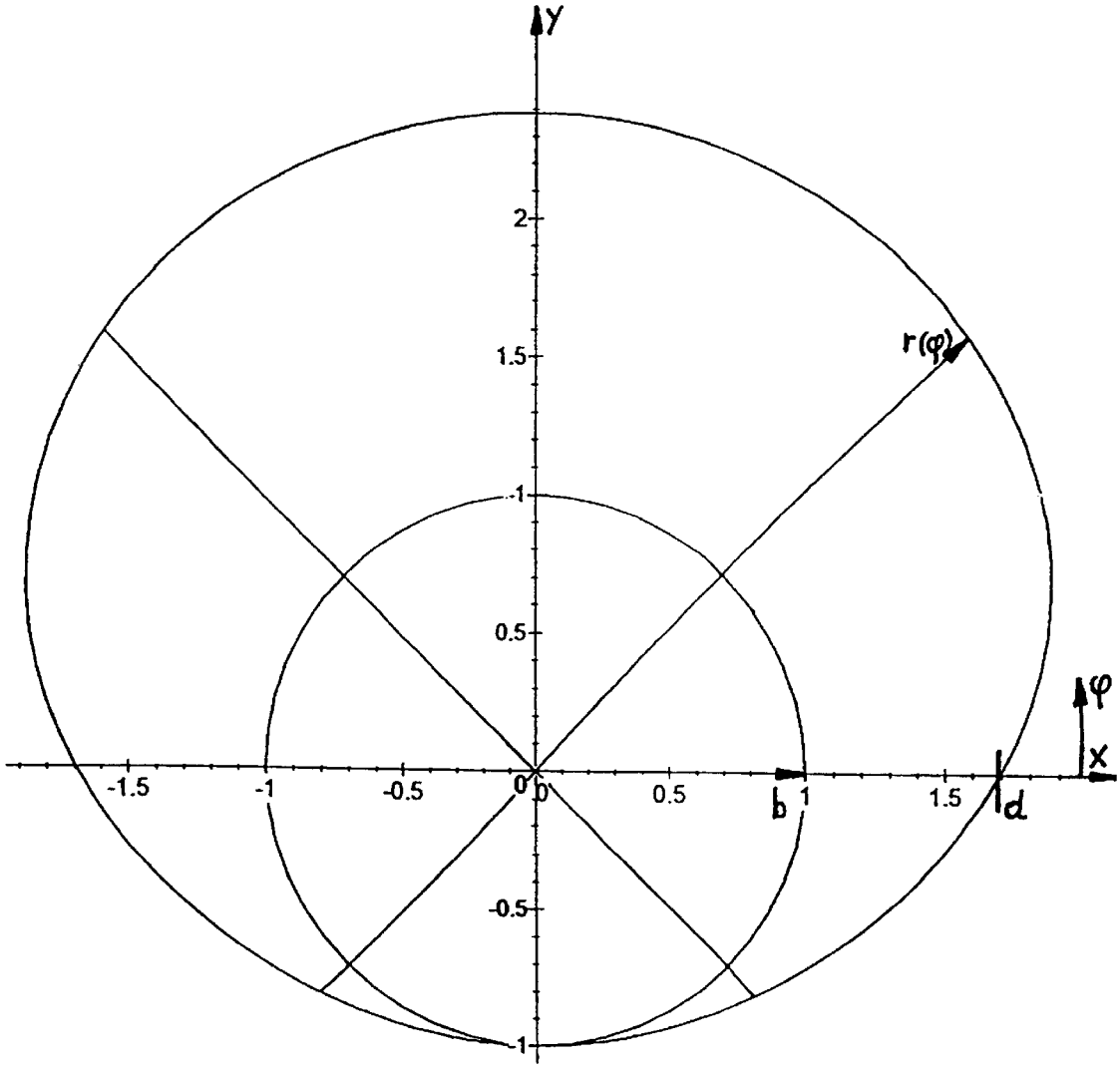
FIG. 2, an enclosure shape with a=2.0 and b=1.
Figure 3:
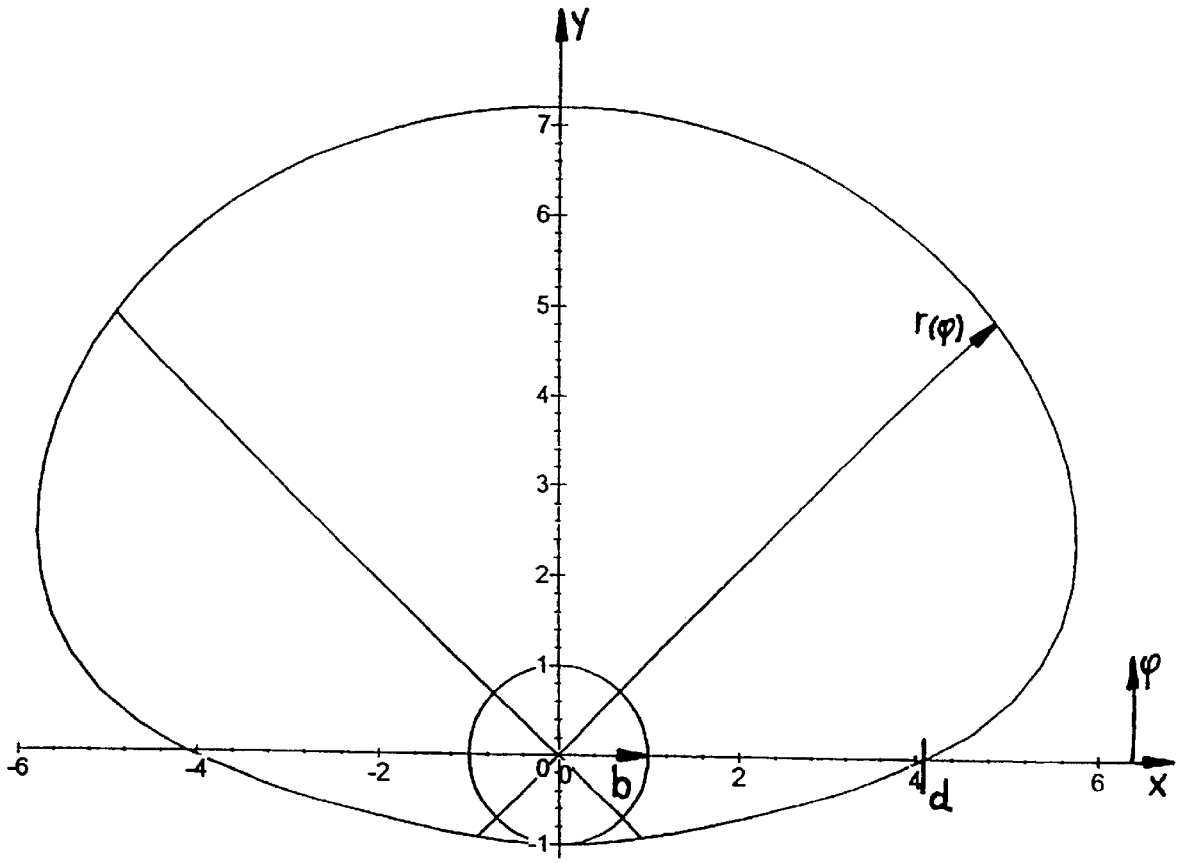
FIG. 3, an enclosure shape with a=5.0 and b=1.

FIGS. 1—3 show various constructions of enclosure shapes that can be employed in keeping with the invention as functions of parameters a and b. The coordinate systems used, the south pole S, and the distances b and d are also entered with b set to 1 in each case since the shape of the curve depends only on the ratio a/b, and thus also, based on the relationship above, on a/d.

As is immediately evident from FIGS. 1–3, according to the invention enclosure shapes in the range of a/b [from] ¼ [to] 2 are certainly technically practicable while, for values of a/b that are considerably higher, strong accelerations of the slides appear when the latter are situated in an equatorial position (parallel to the X-axis). Additionally, contact forces from the enclosure wall that press strongly and are directed out of the slide plane are also active in this position, and thus do not qualify such shapes for technical utilization.

Usable ratios a/b lie between 1.0 and 2.5, preferably between 1.25 and 2.0, a and b having the significance stated above.

Even for the ratios shown in FIGS. 1 and 2, and obviously also for those in which a <1.5 or only slightly more than 2, a rotary piston machine is created which does not exhibit the disadvantages of previously known machines and, in particular, has favorable dynamic conditions for the motion of the slides in the radial direction of the rotor and also along the inside enclosure wall.

Figure 4:
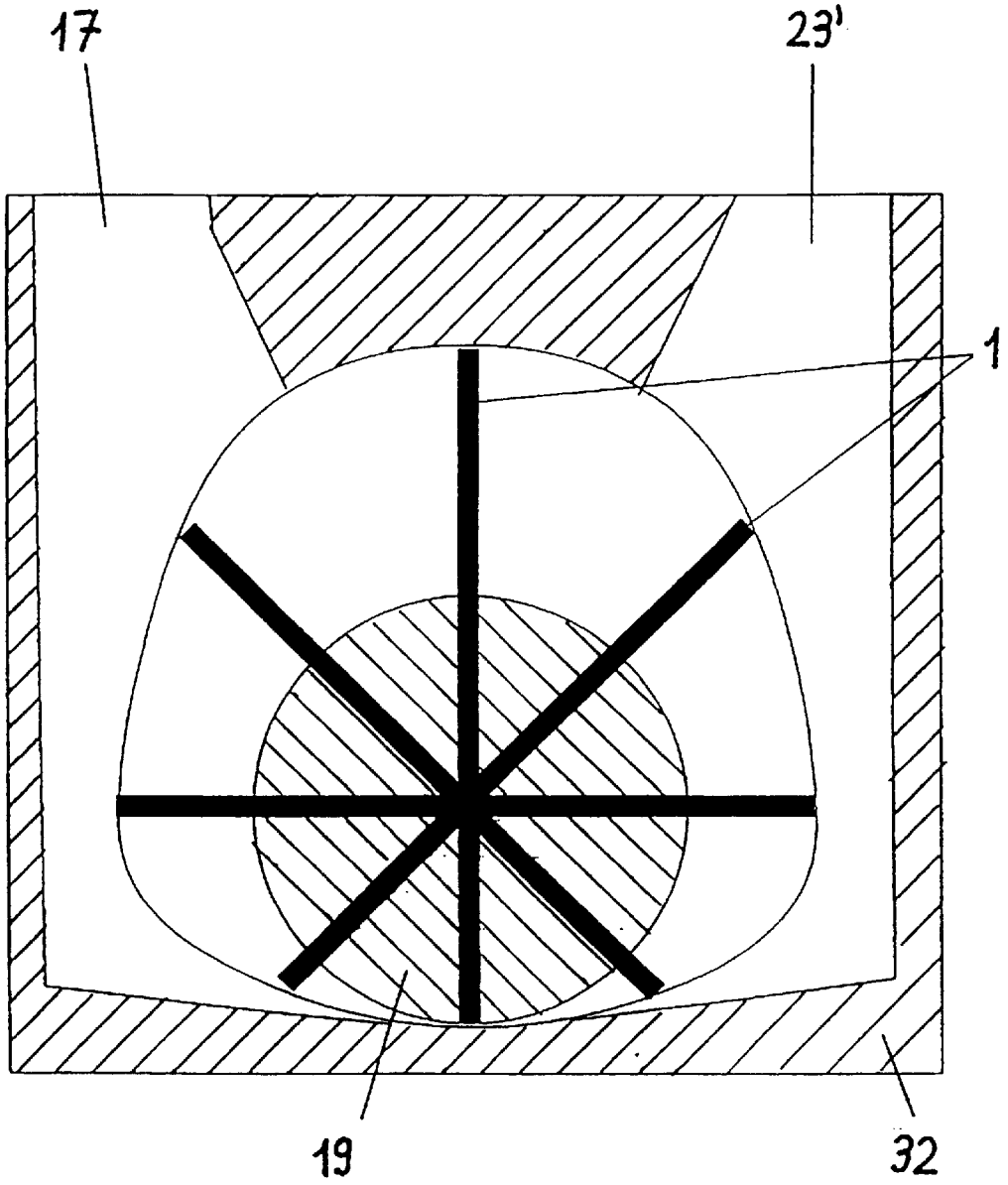
FIG. 4, a section through a turbine or ventilator.

FIG. 4 shows a section perpendicular to the axis of rotation of a turbine or ventilator according to the invention. Slides 1 move in the rotor 19 guided in oil, as is explained in detail below. In the enclosure wall 32, drawn in only schematically in all illustrations, the suction opening 17 and the pressure opening 23 are shown schematically by hatching.

Use as a pump for generating a vacuum and for pumping fluids as well as for compressing can be accomplished in an analogous but reversed manner.

Figure 5:
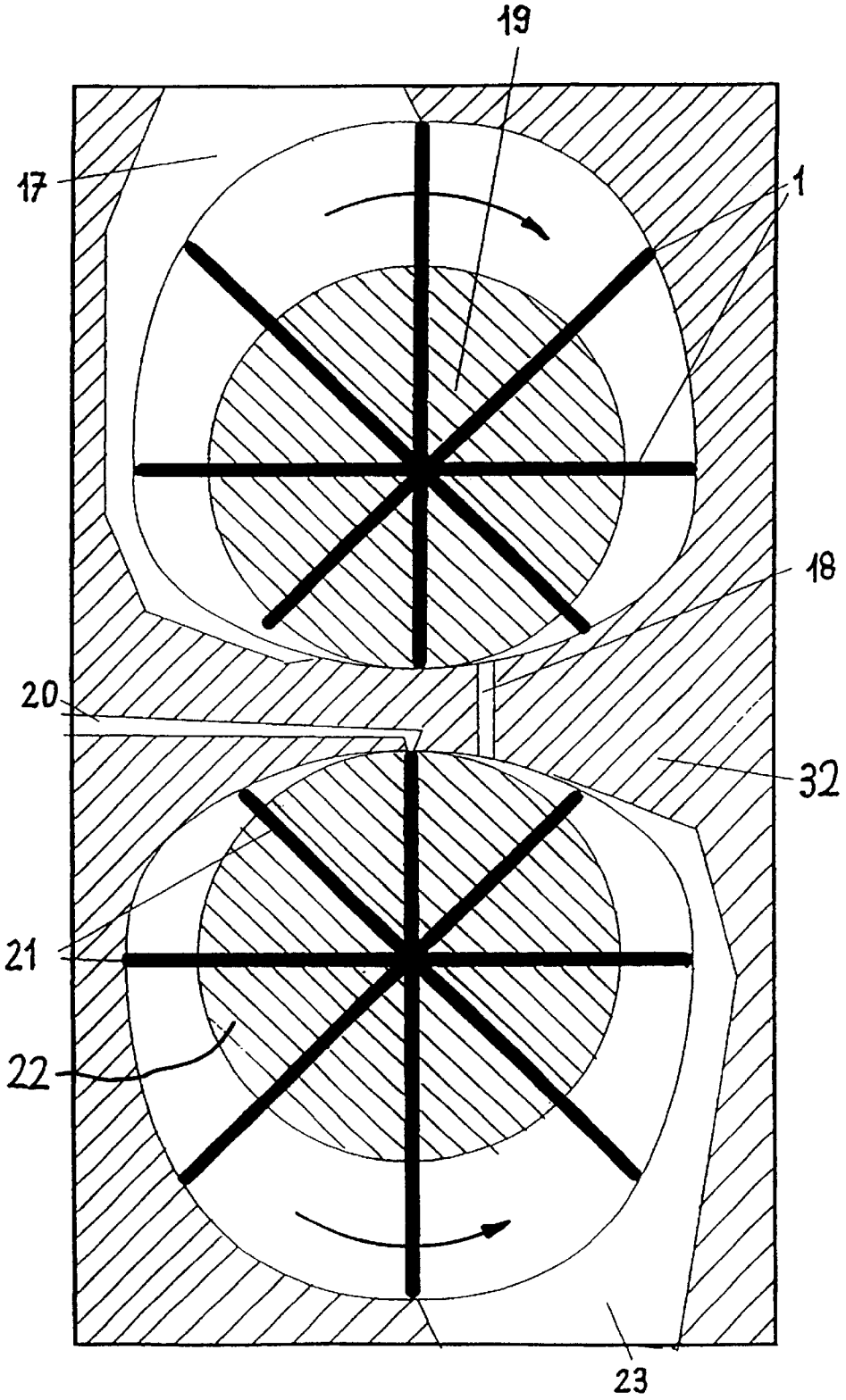
FIG. 5, a section through a two-stage rotary piston internal combustion engine.

FIG. 5 shows a section of a rotary piston internal combustion engine perpendicular to the axis of rotation according to the invention. A suction opening 17 of a compressor stage is schematically drawn in the enclosure wall 32, as well as an overflow channel 18 which leads from the compression side of the compressor stage to the suction side of the engine stage. There is an injection nozzle 20 shown in the area of the expansion chamber.

The slides 1 of the compressor stage are again guided in oil in the rotor 19; for thermal reasons, this is not possible for the slides 21 of the rotor 22 in the combustion chamber.

Figure 6:
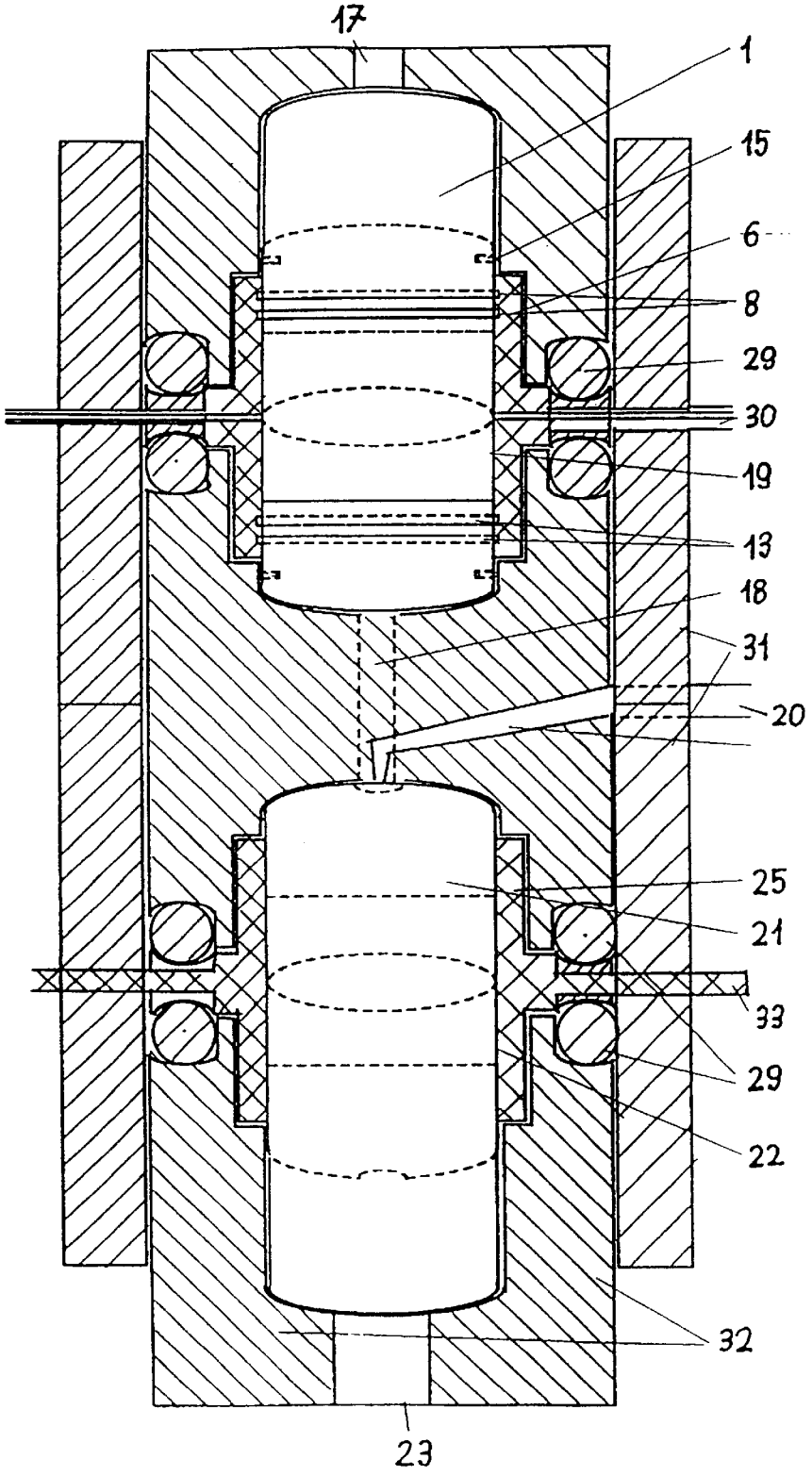
FIG. 6, an axial section through a rotary piston internal combustion engine.

The spent combustion gases leave the rotary piston internal combustion engine at the exhaust opening 23. FIG. 6 shows a section through the parallel rotor shafts 30, 33 of the two rotors 19, 22 of FIG. 5. In particular, the rounded corner shaping of the enclosure chambers can be discerned from this figure. The bearings 29 for the rotors 19, 22 and the gears 31 that ensure the powering of the compressor rotor 19 are shown.

Figure 7:
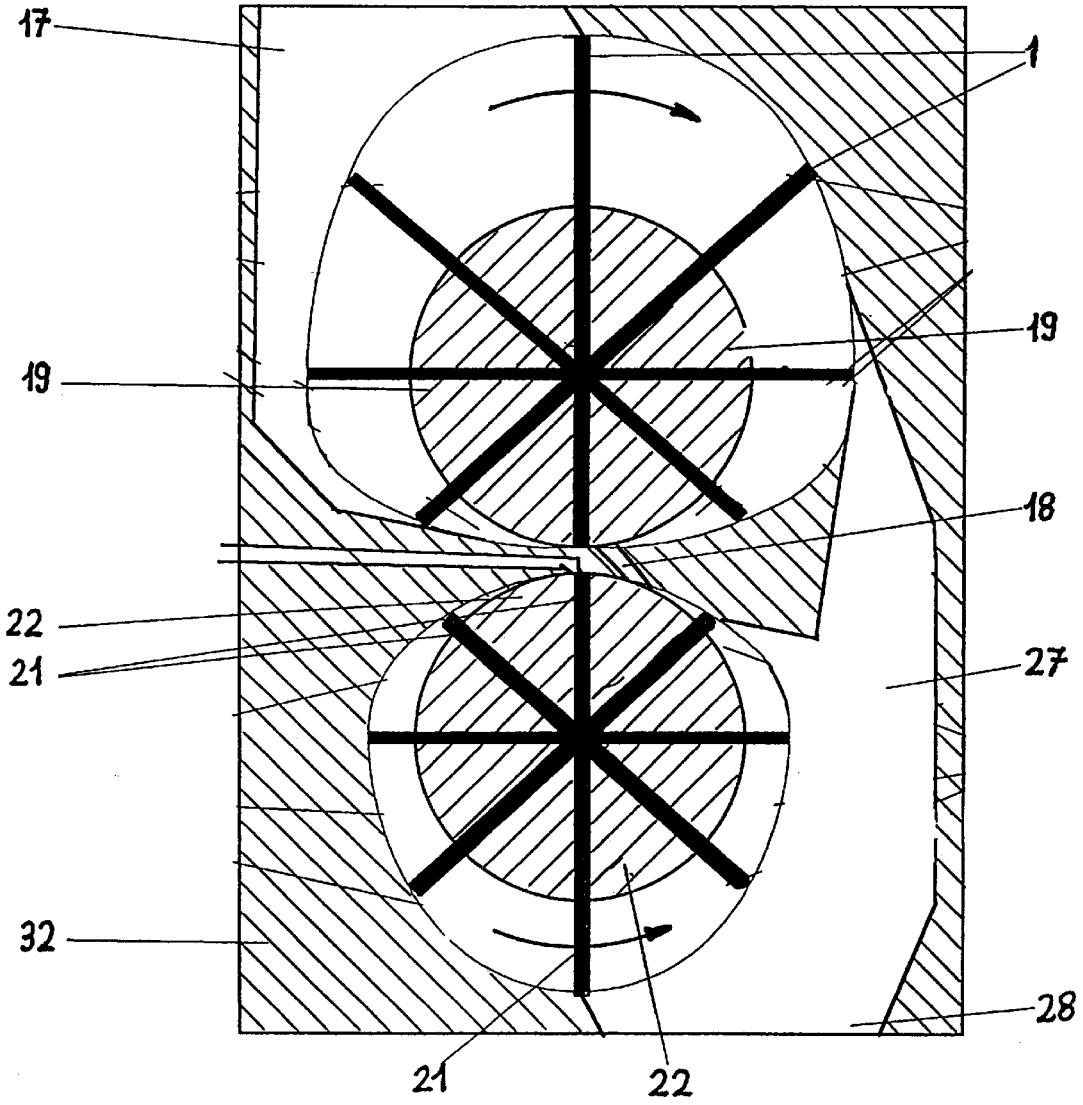
FIG. 7, a section through a rotary piston internal combustion jet engine.

FIG. 7 shows a section perpendicular to the rotor shafts of a rotary piston jet engine. A precompressor outlet opening issues into an expansion chamber 27 that ends in the exit nozzle 28; also evident are the schematically drawn suction opening 17 and the overflow channel 18 that leads from the precompressor stage into the expansion stage. The slides 1 guided in the precompressor rotor 19 are preferably again guided in oil, while this is not possible for the slides in the rotor 22, as they are highly stressed thermally by the combustion process.

Figure 9:
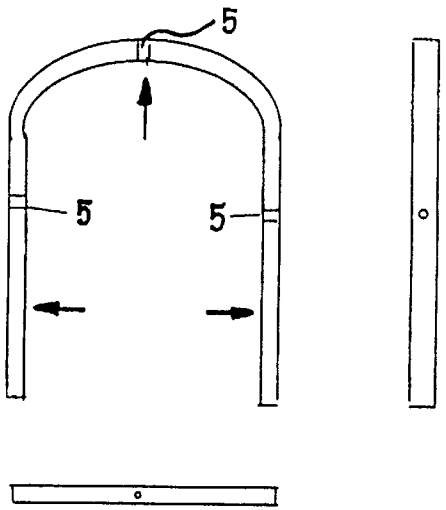
FIG. 9, a spring yoke in section, plan view and side view.
Figure 8:
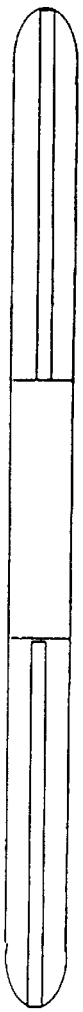
FIG. 8, a slide in section, plan view and side view.
Figure 8:
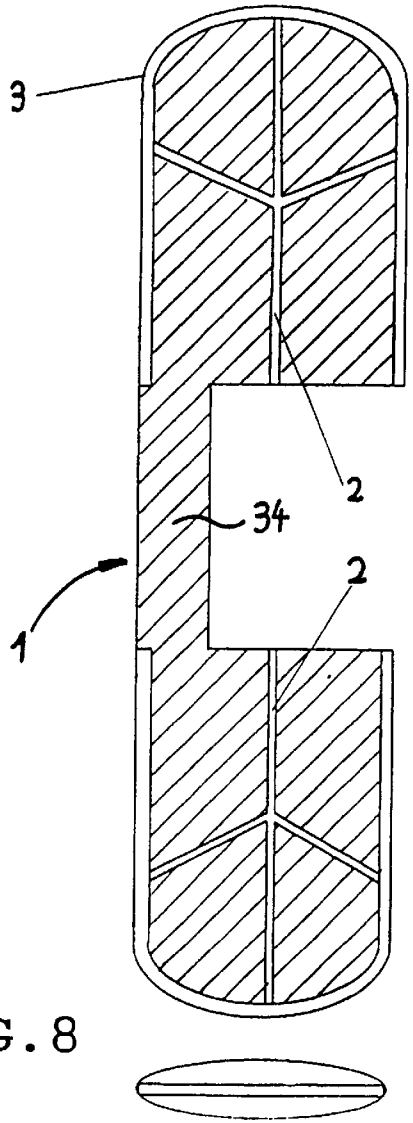

According to the invention, FIG. 8 shows a preferred slide 1, in section, in side view and in plan view, in which grooves 3 are visible into which spring yokes, one of which is represented in FIG. 9, can be inserted. Oil channels 2 are provided in the slider, which, due to the centrifugal acceleration, transport oil that is supplied in the area of the rotational axis outward and there lubricate and cool the slide 1 or spring yoke during its rotation along the inside enclosure wall.

FIG. 9 shows a spring yoke that can be inserted into the grooves 3 of a slide 1 and is provided with lubrication openings 5 from which the lubricating fluid can exit. The arrows indicate the direction of the (slight) elastic deformation caused by the centrifugal acceleration, by which deformation the seal on the inside enclosure wall is improved.

The bridges 34 between the two ends of the slide 1 are offset in the individual slides of a rotor by at least the bridge width, so that the individual slides are arranged to be radially movable past one another.

Figure 10:
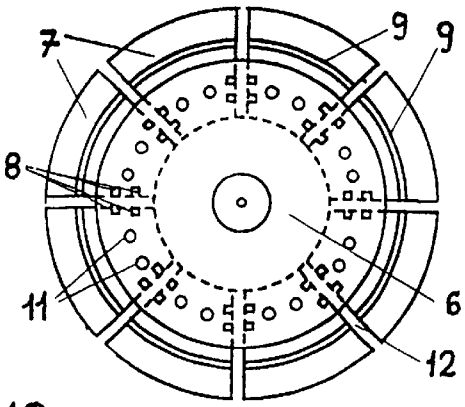
FIG. 10, a rotor in section and side view.

FIG. 10 shows a rotor for oil-lubricated slides 1 which is thus not able to withstand high thermal stresses since otherwise carbonization of the oil would occur. Other fluids besides oil can be employed for lubrication, both oil and the other fluids being usable for cooling. In the case of vacuum pumps, particularly because oil contamination can not be removed from a vacuum, the slide can be cooled and lubricated by fluids such as water.

Such a rotor 19 preferably consists of rotor segments 7 which are held together with intermediate slot-like spaces by rotor sidewalls with mounting holes 11. The slides 1 slide in the spaces 12. Ellipsoidal rings 13 (FIG. 11) are inserted into grooves 8. The grooves 9 accommodate segment gaskets 15 (FIG. 13); oil supply for the slides 1 or the spring yokes 4 is accomplished through an inlet opening 10 in the rotor shaft.

Figure 11:
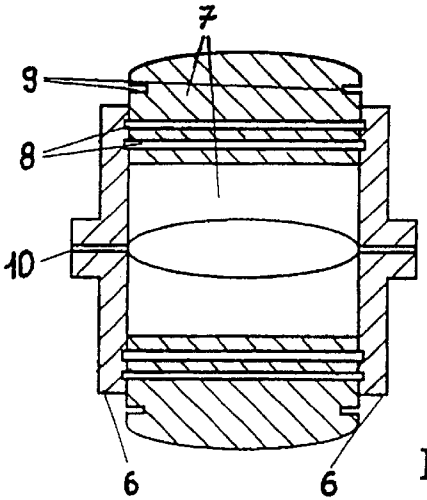
FIG. 11, an ellipsoidal ring in plan view and side view.
Figure 11:
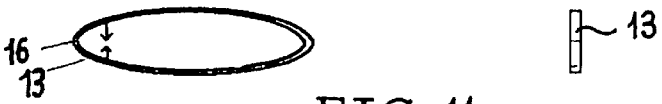

In FIG. 11, an ellipsoidal ring 13 is shown in a side and a plan view. The direction of pressure here is indicated by arrows. The ellipsoidal ring 13 has an opening 16 for equalizing pressure and expansion. The ellipsoidal ring 13 serves to seal the slide 1 off with respect to the rotor; in the illustrated embodiment, two such ellipsoidal rings are provided on each side of the rotor for each of the slides 1, thus, four ellipsoidal rings per slide [are needed].

Figure 12:
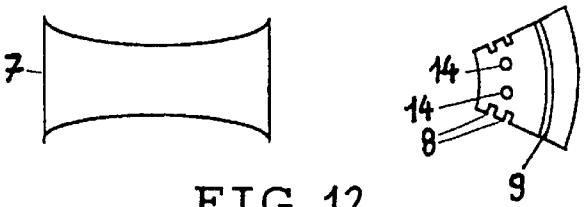
FIG. 12, a rotor segment in front view and side view.

A rotor segment in front and side view can be seen in FIG. 12; the grooves 8 for the ellipsoidal rings 13 or the grooves 9 for the segment gasket 15 (FIG. 13) can also be seen. The holes 14 of the rotator segments 7 cooperate with the holes 11 in the lateral disc 6 and serve to assemble the lateral discs 6, 25 (FIG. 6).

Figure 13:
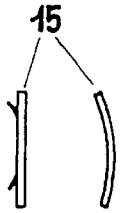
FIG. 13, a segment gasket in front view and side view.

In FIG. 13, a segment gasket 15 is represented in front and side view. This segment gasket 15 seals off the rotor with respect to the lateral enclosure wall and is constructed to be self-contacting.

FIG. 14 shows a rotor able to withstand high thermal stresses in an axial section in which a combustion chamber 26 is provided in each segment. An individual rotor segment is shown in front and side view in FIG. 15; FIG. 16 shows an associated slide 21, which differs from slide 1 in its lack of an oil supply and thus of lubrication. Here too, the bridges 34 are arranged as for slide 1 (FIG. 8).

The mode of operation of the rotary piston machine, according to the invention, is the same as that for ordinary rotary piston machines; except for the dynamic improvements of the slide movement and of the spatial configuration of the slides which thereby becomes possible, no change from prior art regarding operation has taken place.

What is claimed is:

1. Rotary piston machine in which at least one rotor (19, 22) rotates in an enclosure (32), and radially movable slides (1, 21) in the rotor form chambers of varying volume between the enclosure and the rotor, wherein an even number of slides is provided and mutually opposing slides are joined together in a rigid unit, characterized in that the rotor is arranged eccentrically in the enclosure, in that the enclosure is symmetrical with respect to the connection line between the axis of the rotor and the point of the enclosure closest to this axis, the south pole (S) and in that, based on an XY coordinate system placed through the axis of rotation of the rotor and running orthogonally to and in the direction of the axis of symmetry, and on polar coordinates (r, j) with their center in the rotor shaft and the angle j=0 lying in the direction of the positive X-axis, the inside wall of the enclosure (32) satisfies the following equation:

$$r_{(j)}=\{a>>b>>/[a>> \cos >>(1(j+D/2))+b>> \sin >>(1(j+D/2))]\}^{1/2}$$

where:

b is the shortest distance between the rotor shaft and the enclosure wall at the south pole (S), a is given by the formula $$a_{(d,b)}=\{[3(d/2)^4-2b>>(d/2)>>]/[2(d/2)>>-b>>]\}^{1/2}$$

where:

d is the length of the chords of the inside enclosure wall through the axis of rotation of the rotor, thus, the radial extension of the slides (1, 21), and 1 is given by the formula $$1=2/D \arccos (\{[a>>-(a^4+b^4-a>>b>>)^{1/2}]/(a>>-b>>)\}^{1/2}).$$

2. Rotary piston machine according to claim 1, characterized in that the ratio a/b lies between 1.0 and 2.5, preferably between 1.25 and 2.0, a and b having the meaning specified above.

3. Rotary piston machine according to claim 2, characterized in that its slides (1) have oil channels (2) running essentially radially which interact with oil channels (5) in spring yokes (4) that are seated in grooves of the slides (1), and seal off the latter against the inside enclosure wall in order thereby to achieve a reduction of the friction between inside enclosure wall and slide.

4. Rotary piston machine according to claim 1 characterized in that its slides (1) have oil channels (2) running essentially radially which interact with oil channels (5) in spring yokes (4) that are seated in grooves of the slides (1), and seal off the latter against the inside enclosure wall in order thereby to achieve a reduction of the friction between inside enclosure wall and slide.

* * * * *